US005979678A

United States Patent [19]

Kelly

[11] Patent Number: 5,979,678

[45] Date of Patent: Nov. 9, 1999

[54] INTERLOCKING TOOL-FREE-ASSEMBLY

[75] Inventor: Gary L. Kelly, Greendale, Ind.

[73] Assignee: E-Tree, Inc., Lawrenceburg, Ind.

[21] Appl. No.: 09/041,472

[22] Filed: Mar. 11, 1998

[51] Int. Cl.[6] ..... A47B 43/00

[52] U.S. Cl. ..... 211/189

[58] Field of Search ..... 211/189, 85.2, 211/118, 126.6, 186, 149, 195; D6/429

[56] References Cited

U.S. PATENT DOCUMENTS

| | | | |
|---|---|---|---|
| D. 93,006 | 8/1934 | Dunkelberger . | |
| 118,478 | 8/1871 | Parker | 211/189 |
| D. 197,364 | 1/1964 | Rotondo | D80/9 |
| D. 324,832 | 3/1992 | Boschetto et al. | D11/118 |
| 358,935 | 3/1887 | Kohler | 211/189 |
| 1,757,398 | 5/1930 | Squires | 211/189 |
| 1,881,423 | 10/1932 | Favreau . | |
| 2,865,122 | 12/1958 | Clawson | 40/124 |
| 2,916,843 | 12/1959 | Meyer | 41/15 |
| 4,315,376 | 2/1982 | Eichenauer | 40/124.4 |

*Primary Examiner*—Alvin Chin-Shue
*Assistant Examiner*—Sarah Purol
*Attorney, Agent, or Firm*—Biebel & French

[57] ABSTRACT

An assembly of interlocking, flat, relatively stiff components consisting of identical plate members joined by identical spacers forms a decorative display that may be stored and shipped in a flat knocked down configuration and assembled by a relatively inexperienced person without the use of tools or separate fasteners. Besides serving in a purely decorative capacity, the device may be used to display items, such as jewelry, in a retail establishment and also used in a home for storage purposes.

20 Claims, 9 Drawing Sheets

INTERLOCKING TOOL-FREE-ASSEMBLY

BACKGROUND OF THE INVENTION

While decorative or display units constructed primarily from multiple sheet members are known, they generally require components of several different configurations and various fasteners, and/or may require tools for their assembly. See for example U.S. Pat. Nos. 1,881,423; 2,865,122; 2,916,843; and 4,315,376.

Such prior art decorative and display units may be used by merchants and individual consumers, and indeed, a merchant might use such a device to display its products, such as jewelry, and also sell the units to purchasers of such jewelry to be used by the purchaser to store jewelry in their home. It is desirable therefore that devices of this type be capable of being shipped in a flat condition and also easily assembled by a relatively unskilled person without the use of tools and/or fasteners.

A need exists, therefore, for an assembly that can be shipped and/or stored in a flattened condition, consists of a minimum of differently shaped components and can be readily erected by an unskilled purchaser without the need for tools or fasteners to form an attractive, sturdy, three dimensional structure suitable for a variety of purposes such as a jewelry tree, a revolving hanger, an advertising marquee and a mobile or stationary decoration.

SUMMARY OF THE INVENTION

The present invention provides an interlocking assembly that can be stored and shipped in a flat, knocked down condition and erected without the use of tools, adhesives, staples or other fasteners, for use for a variety of purposes, such as a jewelry tree, a revolving hanger, an advertising marquee and a three dimensional mobile or stationary decoration. The basic components of the assembly are a plurality of identical plate members and a plurality of identical spacers that interconnect sets of plate members to form sub-assemblies which are joined to each other to form the interlocking assembly of the present invention.

The individual components may be formed of any suitable, relatively stiff sheet material, such as metal, plastic, wood, stiff paper or cardboard, and the assembly may stand alone, be suspended from a wire or the like or mounted on a stand for rotary motion.

The plate members may be of various shapes and in one preferred embodiment the plate members are configured such that when assembled and mounted on a stand the overall appearance is that of a tree. When used for the display or storage of jewelry, such as earrings, the periphery of the plate members may be provided with openings to receive earring posts or the like.

While one form of the invention incorporates pairs of plate members interconnected by four-sided spacers, the same principles of the invention may be applied to form sub-assemblies consisting of three or more plate members interconnected by six or more-sided spacers. Such three, four or more plate members interconnected by six, eight, etc., sided spacers to form more complex sub-assemblies, may nonetheless be then interlocked in the same manner as the basic sub-assemblies described in detail herein to form more complex interlocked assemblies.

These and other features and advantages of the present invention will be more readily apparent from the following detailed description.

DETAILED DESCRIPTION OF THE PREFERRED EMBODIMENTS

Figure 1A:
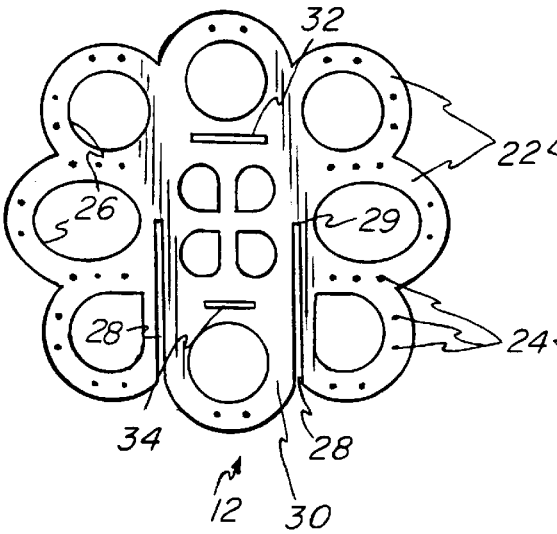
FIGS. 1A–D are front elevational views of a first embodiment of plate members in accordance with the present invention.
Figure 1B:
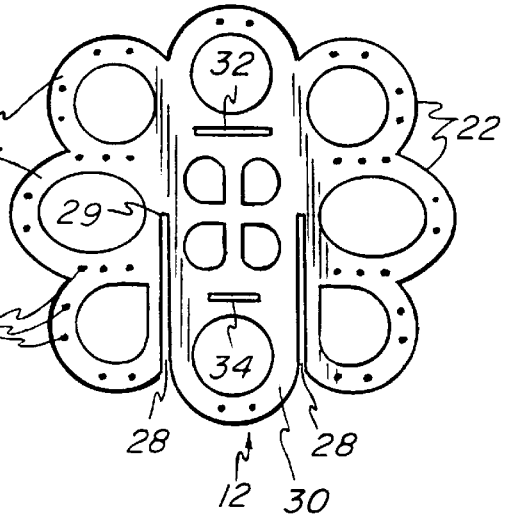
Figure 1C:
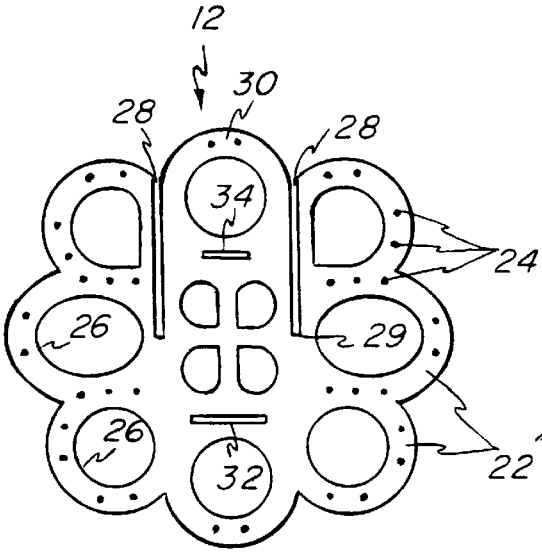
Figure 1D:
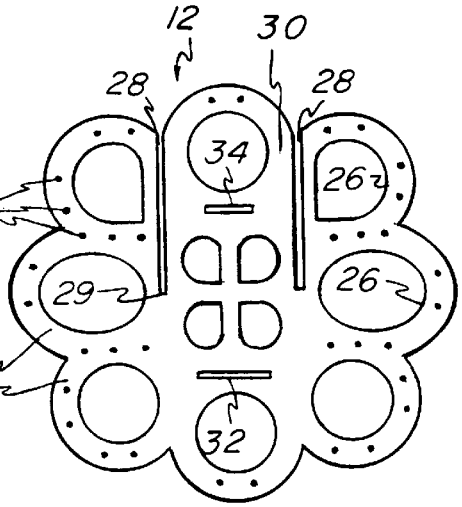

Although in a preferred embodiment of the present invention as described below, a pair of sub-assemblies are described, each consisting of two plate members interconnected by a four-sided spacer member having opposed spacer ears and locking tabs, it is within the scope of the present invention to vary the number of plate members and the configurations of the spacers. For example, rather than a sub-assembly consisting of only two plate members and a four-sided spacer, a sub-assembly could be constructed of three plate members and a six-sided spacer having alternating spacer ears and locking tabs. However, for purposes of simplification, the invention will be described in its most rudimentary form comprising sub-assemblies each formed of two plate members and a four-sided spacer, which may then be joined with a second, substantially identical sub-assembly to form an interlocking assembly in accordance with the present invention.

Thus, as seen in FIGS. 1A–D, each plate member 12 comprises means forming a pair of open-ended channels 28 extending inwardly from a first edge of the plate member and terminating at a closed terminal end 29 inwardly of said first edge. Each of the plate members 12 also comprises means forming closed-ended spacer slots 32 extending in non-parallel relationship to said channels 28 intermediate said channel terminal ends and a second edge of said plate member 12 opposite the first edge thereof. Additionally, the plate members 12 are provided with closed-ended locking slots 34 extending parallel to the slots 32 and positioned intermediate the channels 28.

Figure 2A:
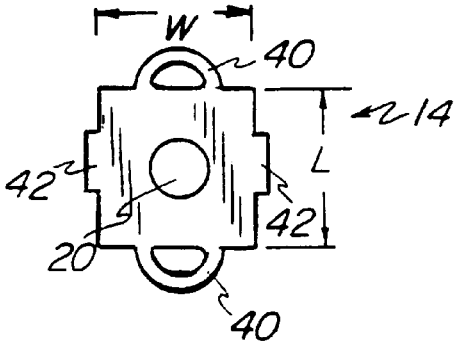
FIGS. 2A and B are top plan views of spacers in accordance with the present invention.
Figure 2B:
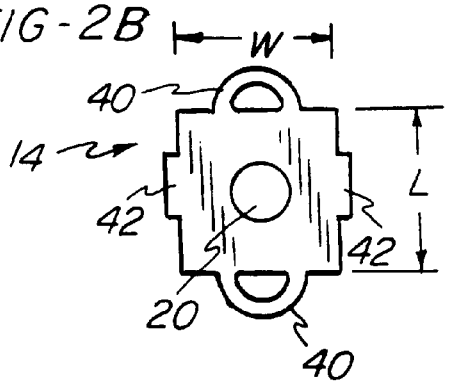

A second component of the interlocking assembly of the present invention is shown in FIGS. 2A and B. As seen in FIGS. 2A and B, spacers 14 each have four sides with opposed spacer ears 40 projecting from opposite sides of each spacer and locking tabs 42 positioned intermediate spacer ears 40. Additionally, each spacer 14 may include means defining a central opening 20 for purposes to be presently described.

Figure 4:
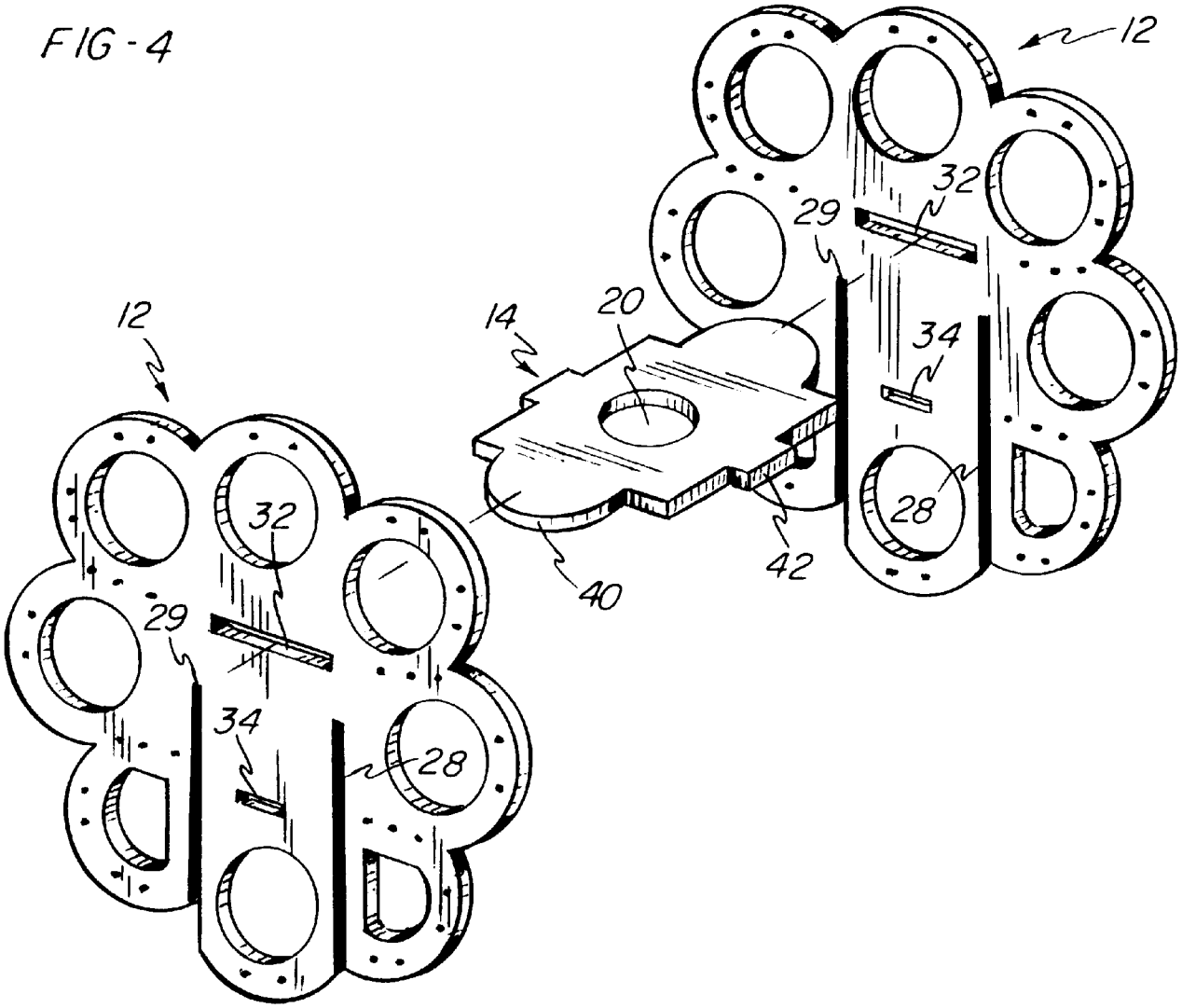
FIG. 4 is an exploded perspective view illustrating the sub-assembly of a pair of plate members with a spacer.
Figure 5:
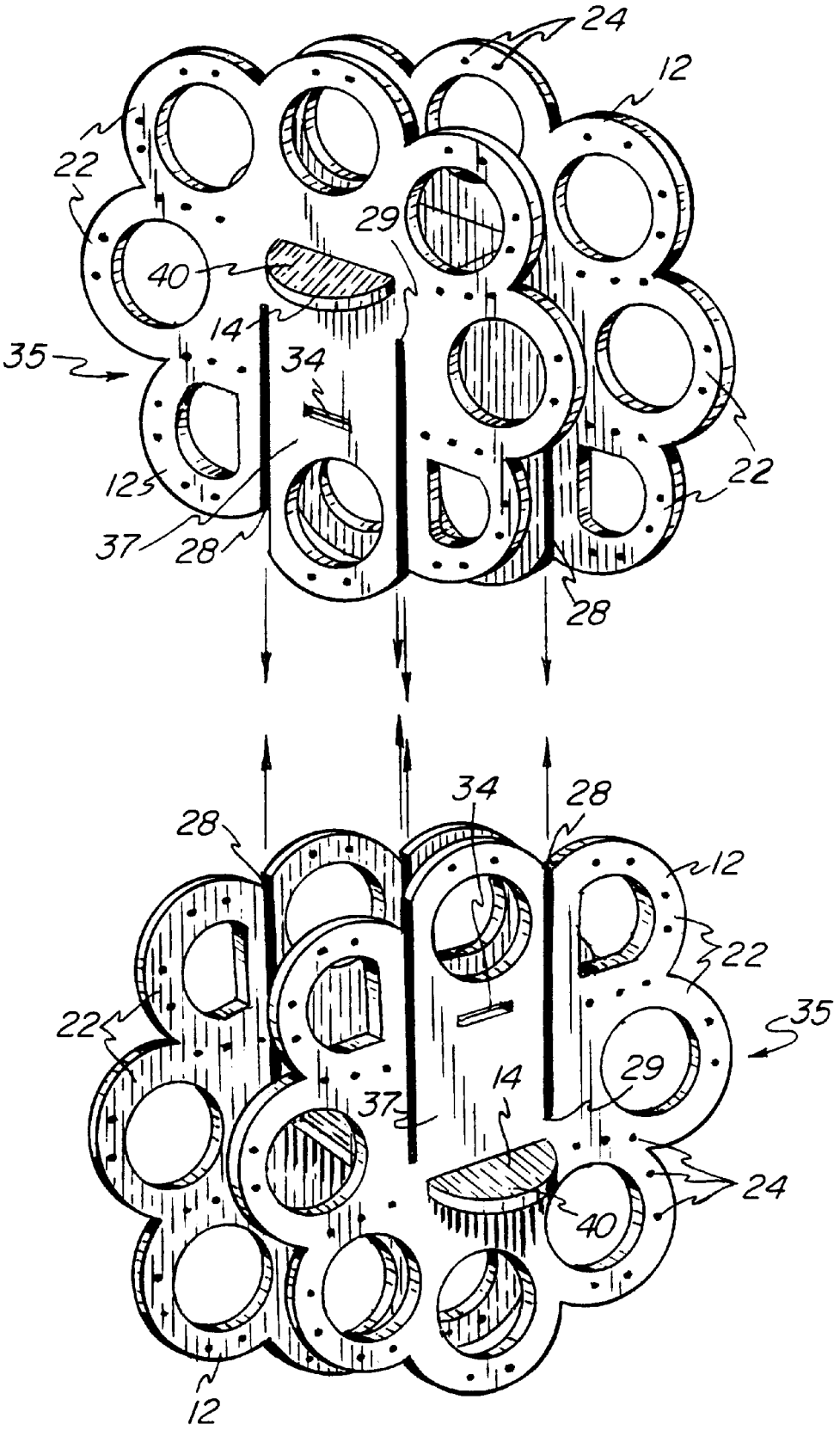
FIG. 5 is an exploded perspective view showing a pair of sub-assemblies positioned to be engaged with one another.

Turning to FIG. 4 of the drawings, it will be seen that a pair of plate members 12 are arranged in spaced, parallel relationship with a spacer 14 interposed between them such that, as seen in FIG. 5, the spacer ears 40 may be received in the spacer slots 32 to form a sub-assembly 35 of substantially C-shape. A pair of sub-assemblies 35 are then positioned at 90° with respect to each other and with their channels 28 aligned to permit the opposing plate members of each sub-assembly to be received in the channels of the opposite sub-assembly. The two sub-assemblies are then moved toward and into engagement with each other, with opposing plate members being received in the channels of the opposite sub-assembly. Continued pushing of the two sub-assemblies toward each other causes the locking tabs 42 to slide along the inner surfaces of resilient tongues 37 formed in each plate member 12 by the parallel channels 28. As they do, the tongues 37 flex outwardly until eventually, the locking tabs 42 snap into place in the locking slots 34 to form the interlocked assembly shown in FIGS. 6–9 of the drawings.

Figure 3A:
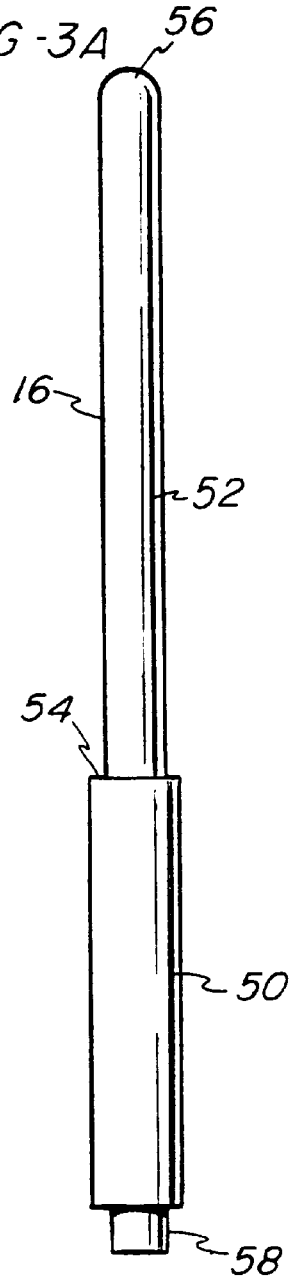
FIG. 3A is an elevational view of a shaft that may be used to support the interlocked assembly.
Figure 3B:
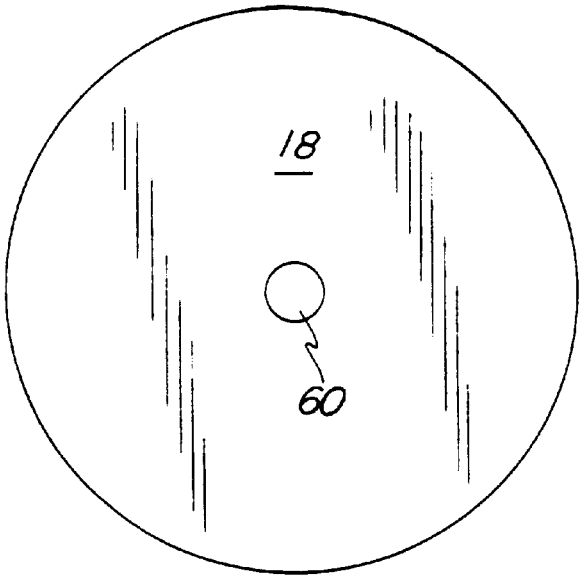
FIG. 3B is a top plan view of a base for receiving the shaft of FIG. 3A.
Figure 6:
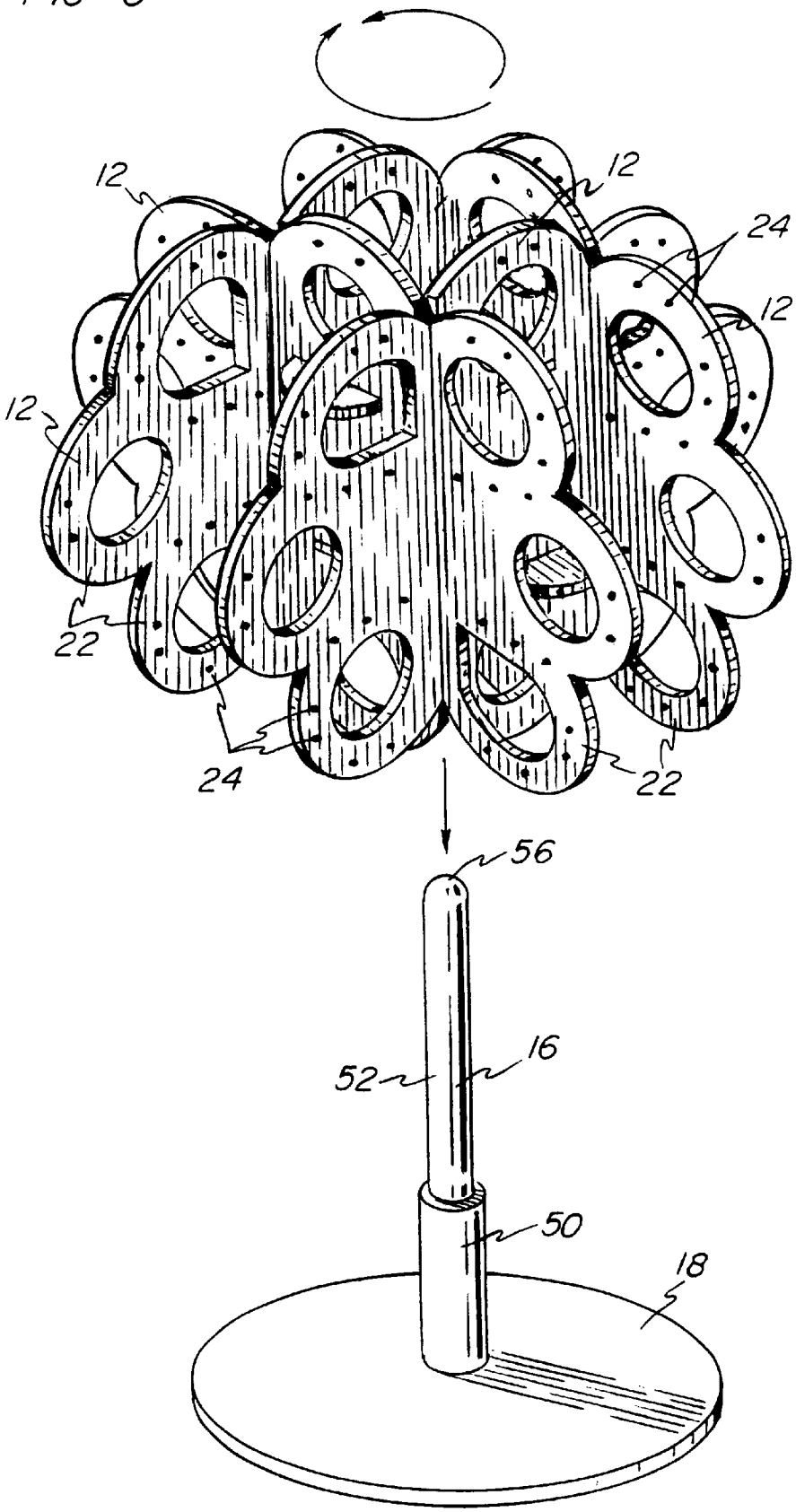
FIG. 6 is also an exploded perspective view, but showing the sub-assemblies of FIG. 5 now interlocked and about to be positioned on the post and base of FIGS. 3A and B.
Figure 7:
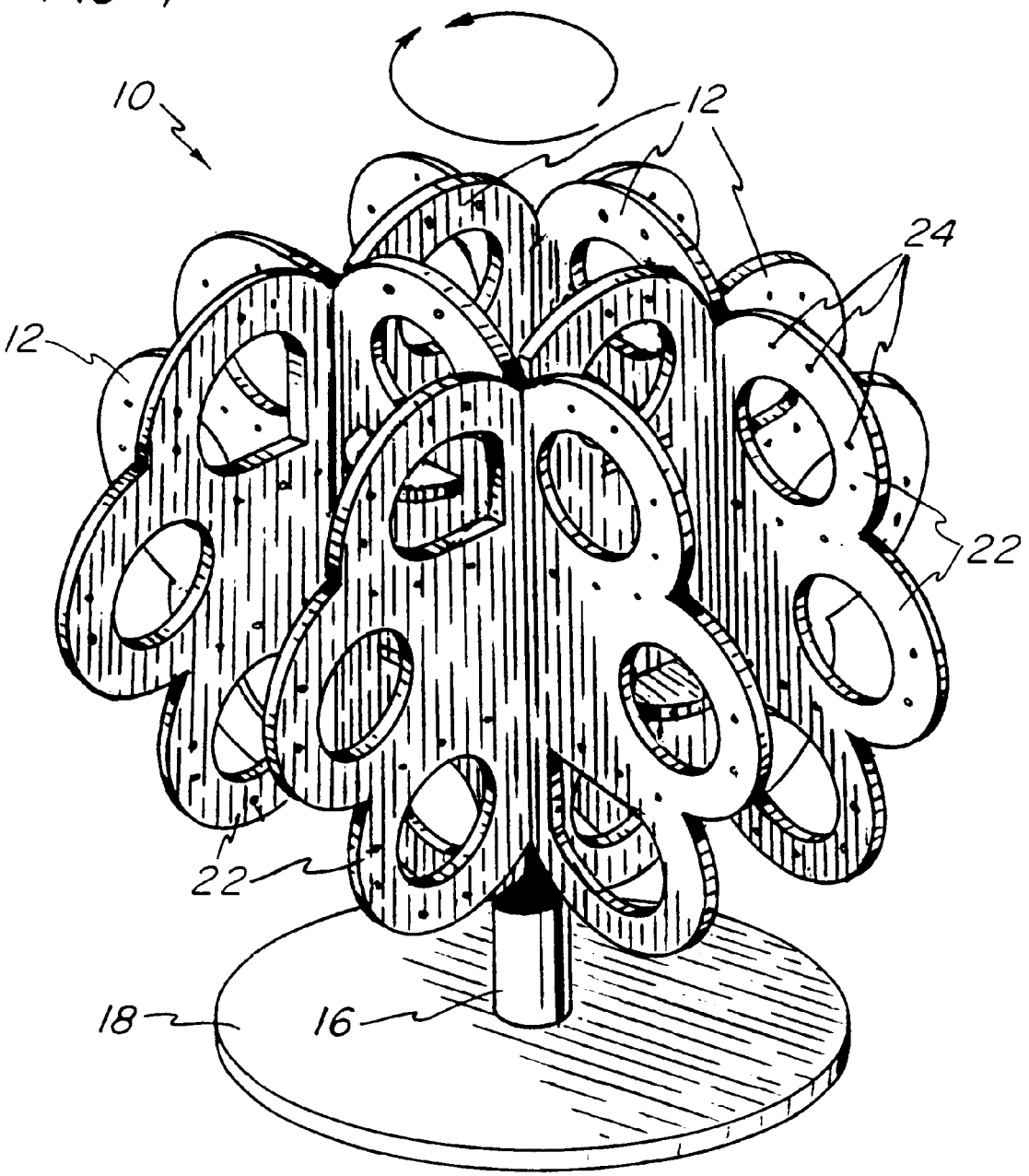
FIG. 7 is a perspective view of an interlocking assembly in the form of a decorative display or jewelry tree.
Figure 8:
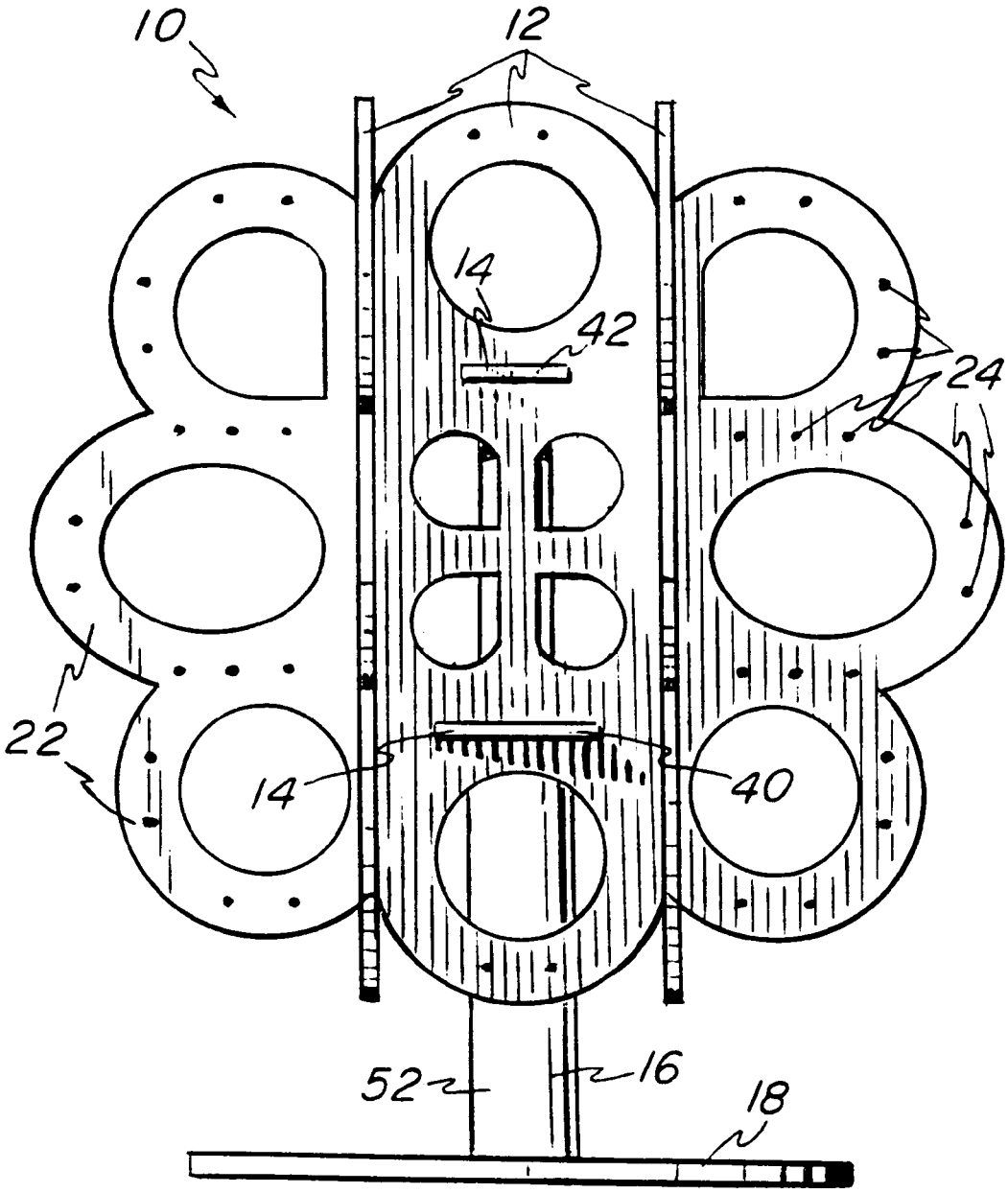
FIG. 8 is a front elevational view of the assembly of FIG. 7.
Figure 9:
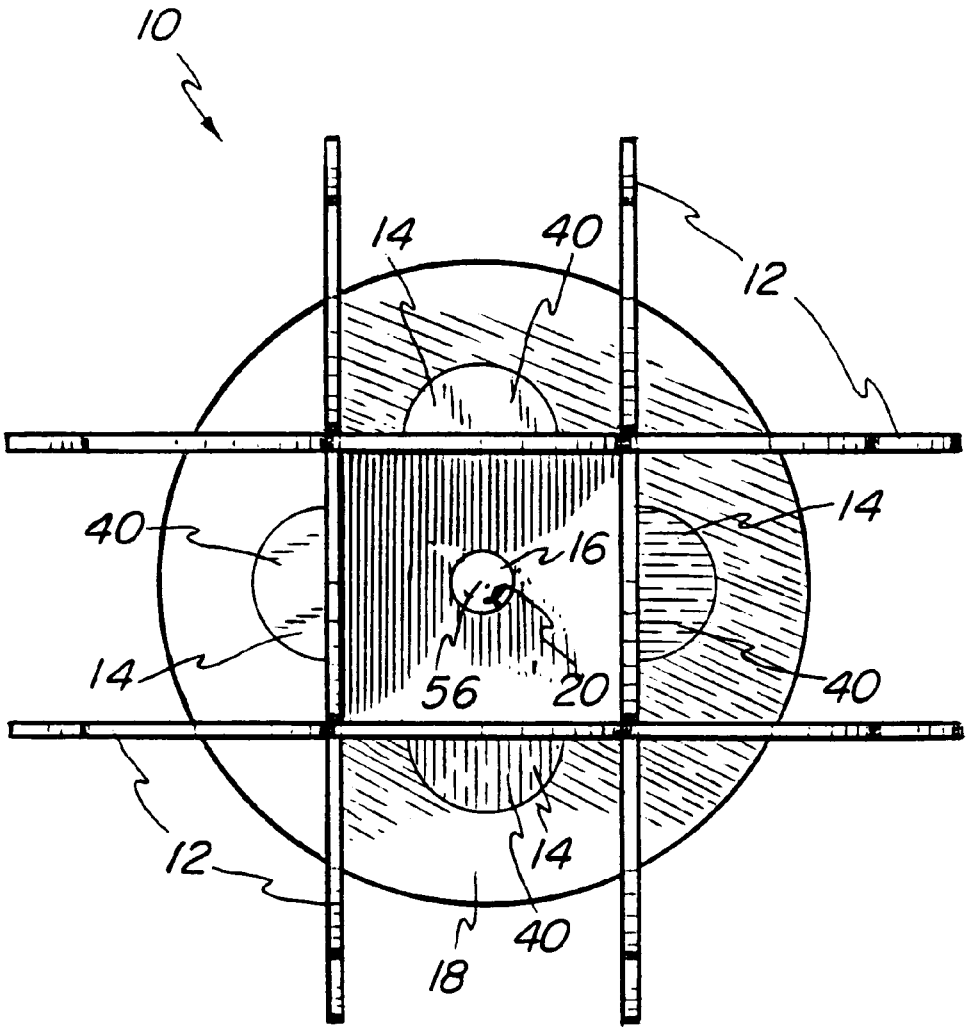
FIG. 9 is a top plan view of the assembly of FIG. 7.

A complete interlocked assembly 10 may be suspended from a wire or the like as a mobile decoration, simply placed upon a table or other supporting surface or, as shown in FIGS. 7–9, rotatably mounted on a shaft 16 received in a base 18. In this configuration it will be noted that the shaft, as best seen in FIGS. 3A and 6 of the drawings has a greater diameter 50 and a lesser diameter 52, which together define a shoulder 54. The length of the shaft 16 from the shoulder 54 to its tip 56 is such that it is adapted to be received in the holes 20 formed in the spacers 14, as illustrated in FIGS. 2A and B and 9 of the drawings. With its reduced lower end 58 received within the opening 60 in the base 18, the shaft 16 supports the assembly 10 for rotatable movement.

Figure 10:
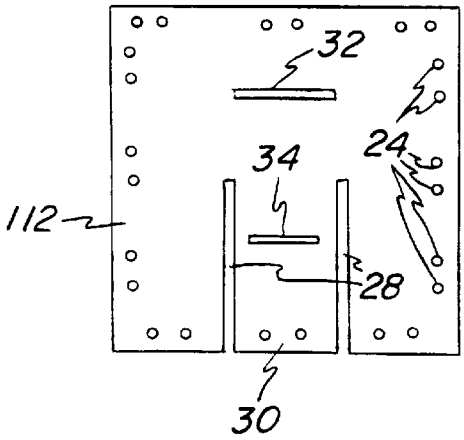
FIGS. 10–12 are front elevational views of second, third and fourth, respectively, plate members in accordance with the present invention.
Figure 11:
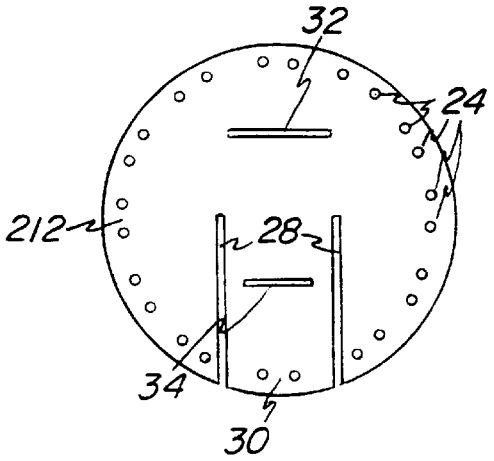
Figure 12:
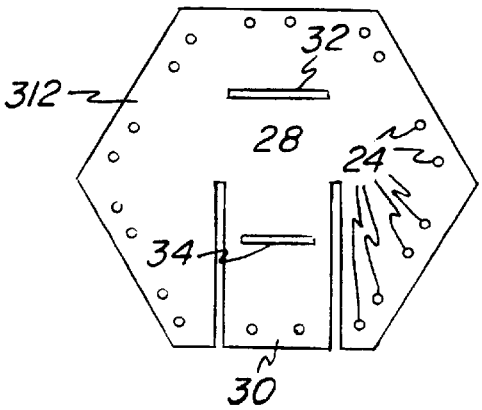

While in the construction described above the plate members basically comprise a series of lobes 22 that, when assembled as shown in FIG. 7, give the general appearance of a tree, it will be apparent that the plate members may assume other forms within the principles of the present invention. Thus, as seen in FIG. 10, a plate member 112 is of generally square configuration and has spacer slots 32, locking slots 34 and channels 28. Similarly, the plate member 212 of FIG. 11 is provided with means defining open ended channels 28, spacer slots 32 and locking slots 34, although the configuration is circular. FIG. 12 shows still a fourth embodiment in which the plate member 312 has a generally hexagonal configuration, but nonetheless includes open ended channels 28, spacer slots 32 and locking slots 34. Additionally, all four embodiments of the present invention may be provided with openings 24 about their periphery to receive the posts of earrings if the present invention is to be used as a display or storage stand for jewelry.

Regardless of the specific configuration of the plate members, and the number of plate members incorporated into a single sub-assembly, the present invention nonetheless provides an attractive, sturdy construction that may be used as a jewelry tree, a revolving hanger, an advertising marquee and a stationary or mobile decoration, which may be shipped and stored in a flat, knocked down condition, but erected without the use of tools, adhesive, staples or other fasteners by a relatively unskilled person.

While the embodiments just described constitute preferred embodiments of the invention, it is to be understood that the invention is not limited to the precise embodiments disclosed, and that changes may be made therein without departing from the scope of the invention which is defined in the appended claims.

What is claimed is:

1. An interlocking assembly comprising:

a pair of substantially identical sub-assemblies;

each of said sub-assemblies comprising a plurality of substantially flat, stiff components;

said sub-assemblies being received in interlocking relationship with each other and forming said assembly.

2. The assembly of claim 1 wherein each of said sub-assemblies comprises substantially flat, stiff plate members interconnected by substantially flat, stiff spacers.

3. The assembly of claim 2 wherein each of said sub-assemblies is substantially C-shaped.

4. The assembly of claim 3 wherein said sub-assemblies are disposed with the plate members of one sub-assembly positioned at substantially 90° with respect to the plate members of the other of said sub-assemblies.

5. The assembly of claim 1 wherein each of said sub-assemblies comprises a pair of plate members interconnected in substantially parallel relationship to each other by a spacer.

6. The assembly of claim 5 wherein said plate members are each provided with means defining spacer slots and said spacers are provided with spacer ears received in said spacer slots.

7. The assembly of claim 2 wherein said plate members are each provided with open-ended channels extending inwardly from an edge thereof and said plate members of each sub-assembly are received in the channels of the other sub-assembly.

8. The assembly of claim 7 wherein each of said spacers includes locking tabs, each of said plate members includes means defining therein locking slots and said locking tabs of each of said spacers are received in the locking slots of said plate members.

9. The assembly of claim 8 wherein said channels comprise at least a pair thereof in each of said plate members, each of said pair of channels defines a resilient tongue and said locking slots are formed in said tongues.

10. The assembly of claim 1 wherein each of said sub-assemblies comprise substantially identical plate members interconnected by substantially identical spacers and said plate members are provided with earring post receiving apertures adjacent their peripheries.

11. The assembly of claim 2 further comprising means defining shaft receiving openings in said spacers, a base and a shaft mounted in said base and rotatably received in said shaft receiving openings in said spacers.

12. The assembly of claim 2 wherein said plate members comprise a series of lobes that impart a tree-like appearance to said assembly.

13. The assembly of claim 2 wherein said plate members are substantially square.

14. The assembly of claim 2 wherein said plate members are substantially circular.

15. The assembly of claim 2 wherein said plate members are substantially hexagonal.

16. An interlocking assembly comprising:

first and second pluralities of plate members, each of said plate members comprising:

means defining open-ended channels each extending inwardly from a first edge of said plate member and terminating at a closed terminal end inwardly of said first edge, means defining closed-ended spacer slots extending in non-parallel relationship to said channels intermediate said channels terminal ends and a second edge of said plate member opposite said first edge thereof, closed-ended locking slots extending parallel to said spacer slots intermediate said channels, and means defining earring post receiving apertures adjacent peripheries of said plate members, first and second spacers, each of said spacers comprising:

a plurality of spacer ears, a plurality of locking tabs disposed intermediate said spacer ears, and means defining shaft receiving openings in said spacers, said first and second spacers being received by said first and second pluralities of plate members, respectively, with said spacer ears positioned in said spacer slots thereby forming first and second sub-assemblies, respectively, said plate members of said first sub-assembly being received in said plate member channels of said second sub-assembly and said plate members of said second sub-assembly being received in said plate member channels of said first sub-assembly with said terminal ends of said first sub-assembly plate member channels positioned adjacent said terminal ends of said second sub-assembly plate member channels and with said locking tabs of said first spacer received in said locking slots of said second plurality of said plate members and said locking tabs of said second spacer received in said locking slots of said first plurality of plate members to interlock said sub-assemblies with each other, a base, and a shaft mounted in said base, said shaft being rotatably received in said shaft receiving openings of said spacers.

17. An interlocking assembly comprising:

a pair of substantially identical sub-assemblies, each of said sub-assemblies comprising a plurality of substantially flat, stiff plate members interconnected by substantially flat, stiff spacers, said spacers defining shaft receiving openings, said sub-assemblies being received in interlocking relationship with each other;

a base; and a shaft mounted in said base and rotatably received in said shaft receiving openings.

18. The assembly of claim 17 wherein said plate members are each provided with open-ended channels extending inwardly from an edge thereof and said plate members of each sub-assembly are received in the channels of the other sub-assembly.

19. The assembly of claim 18 wherein each of said spacers includes locking tabs, each of said plate members includes means defining therein locking slots, and said locking tabs of each of said spacers are received in the locking slots of said plate members.

20. The assembly of claim 19 wherein said channels comprise at least a pair thereof in each of said plate members, each of said pair of channels defines a resilient tongue, and said locking slots are formed in said tongues.

* * * * *